US006454479B1

(12) United States Patent
Lychwick

(10) Patent No.: US 6,454,479 B1
(45) Date of Patent: Sep. 24, 2002

(54) ORBITAL MARKING PENCIL AND SCRATCH-OFF CARD REMOVER

(76) Inventor: Kurt P. Lychwick, 3100 W. Layton, Greenfield, WI (US) 53221

( * ) Notice: Subject to any disclaimer, the term of this patent is extended or adjusted under 35 U.S.C. 154(b) by 5 days.

(21) Appl. No.: 09/778,509

(22) Filed: Feb. 7, 2001

(51) Int. Cl.[7] ..... B43K 21/22

(52) U.S. Cl. ..... 401/92; 401/48; 401/93; 401/87; 401/29; 401/195; 401/52; 401/117

(58) Field of Search ..... 401/48, 92, 93, 401/94, 87, 195, 117, 29, 31, 52; 81/440, 442; 408/127, 137

(56) References Cited

U.S. PATENT DOCUMENTS 4,529,328 A * 7/1985 Wacha et al. ..... 401/116
4,560,297 A * 12/1985 Leem ..... 401/116
5,052,838 A * 10/1991 Tucker ..... 401/92

* cited by examiner

*Primary Examiner*—David J. Walczak

(57) ABSTRACT

An orbital marking pencil includes a marking retention body, marking convoluted body, and a marking collet. The marking collet retains a piece of lead on one end. The marking collet is retained in the marking convoluted body. The marking convoluted body is threaded into one end of the marking retention body. An orbital scratch-off card remover includes a remover retention body, remover convoluted body, and a lock ring. A remover collet retains a remover rod and is formed on one end of the remover convoluted body. The lock ring is slid over the remover collet. The remover convoluted body is threaded into one end of the remover retention body. The other ends of the orbital pencil and scratch-off card may be attached to each other to form a combination device.

10 Claims, 5 Drawing Sheets

ORBITAL MARKING PENCIL AND SCRATCH-OFF CARD REMOVER

BACKGROUND OF THE INVENTION

1. Field of the Invention

The present invention relates generally to score spaces and scratch-off cards and more specifically to an orbital marking pencil and scratch-off card remover which may be used to fill score spaces and to remove a cover layer (scratch-off ink) on a scratch-off card, respectively.

2. Discussion of the Prior Art

There appears to be no device on the market which may be used specifically to fill in the score spaces on a scholastic test or on a lottery card. A regular soft pencil is usually used to fill the score spaces. One drawback to using a pencil is that the score space may be misread if the user writes beyond the boundary of the score space. Another drawback to using the pencil is the amount of time required to completely fill in the score space.

There are numerous, devices on the market for removing the cover layer of a scratch-off card. However, it appears all these devices require horizontal hand motion which may scratch-off more of the cover layer then is required. Further, it also appears that all manual erasing devices require a horizontal hand motion to remove undesirable writing.

Accordingly, there is a clearly felt need in the art for an orbital marking pencil which may be used to fill-in score spaces on a scholastic test or lottery card without making a horizontal motion across the writing surface. Further, there is a clearly felt need in the art for an orbital scratch-off card remover which may be used to remove a cover layer from a scratch-off card without making a horizontal motion across the scratch-off card.

SUMMARY OF THE INVENTION

The present invention provides an orbital marking pencil and scratch-off card remover which allow a score space to be filled and a cover layer to be removed without making a horizontal motion. The orbital marking pencil includes a marking retention body, marking convoluted body, a marking collet, actuation tube, and rotational support. At least two lead griping fingers are formed on one end of the marking collet and a tube bore is formed on the other end thereof. The tube bore is sized to receive the actuation tube. The gripping lead fingers are sized to firmly retain a piece of lead. A convoluted thread is formed on an outside diameter of the marking convoluted body. The rotational support is pivotally attached to one end of the marking convoluted body. A first bore is formed through substantially the length of the marking convoluted body. A second bore is formed from a bottom of the first bore to through the one end of the marking convoluted body. The second bore is terminated with a tapered exit. The tapered exit is sized to receive a tapered portion of the marking collet.

One end of the actuation tube has a reduced diameter which is sized to be received by the tube bore. A push plug is inserted into the other end of the actuation tube. A first compression spring is inserted into the first bore before insertion of the marking collet into the actuation tube. A convoluted nut is formed on one end of the marking retention body and a tube opening is formed through the other end thereof. The convoluted nut threadably receives the marking convoluted body and the plug opening provides clearance for the push plug. A second compression spring is inserted into a spring bore formed through substantially the length of the marking retention body before the convoluted nut is formed on the marking retention body.

At least one piece of lead is inserted into the marking collet by depressing the push plug and inserting lead directly into the marking collet or into a tube bore of the actuation tube. To mark a score space, the lead is placed directly over the score space and the marking retention body is pushed downward until the marking convoluted body fully threads into the convoluted nut. The marking retention body is pushed down as many times as required to darken the score space.

The orbital scratch-off card remover includes a remover retention body, remover convoluted body, and a lock ring. A convoluted thread is formed on an outside diameter of the remover convoluted body. At least two griping fingers are formed on one end of the remover convoluted body. A first bore is formed through substantially the length of the marking convoluted body. A second bore is formed from a bottom of the first bore through the one end of the remover convoluted body. A convoluted nut is formed on one end of the remover retention body. The convoluted nut threadably receives the remover convoluted body. A compression spring is inserted into a spring bore formed through substantially the length of the remover retention body before the convoluted nut is formed on the remover retention body.

A remover rod is inserted into the at least two gripper fingers of the remover convoluted body. The remover rod is positioned to remove a cover layer from a scratch-off card and the lock ring is pushed on to a tapered outer diameter of the at least two gripper fingers. To remove the cover layer of a scratch-off card, the remover rod is placed directly over the area to be removed and the remover retention body is pushed downward until the remover convoluted body fully threads into the convoluted nut. The remover retention body is pushed down as many times as required to remove a portion of the cover layer.

A combination orbital marking pencil and scratch-off card remover may be fabricated by modifying the other ends of the marking and remover retention bodies. The other end of the remover retention body is modified to be attached to the actuation tube. The other end of the marking retention body is modified to receive the other end of the remover retention body.

Accordingly, it is an object of the present invention to provide an orbital marking pencil which is capable of filling a score space with out making a horizontal motion during marking.

It is a further object of the present invention to provide an orbital scratch-off card remover which is capable of removing a portion of a cover layer of a scratch card without making a horizontal motion.

Finally, it is another object of the present invention to provide a combination orbital marking pencil and scratch-off card remover by attaching the other ends of each device.

These and additional objects, advantages, features and benefits of the present invention will become apparent from the following specification.

DETAILED DESCRIPTION OF THE PREFERRED EMBODIMENTS

Figure 1:
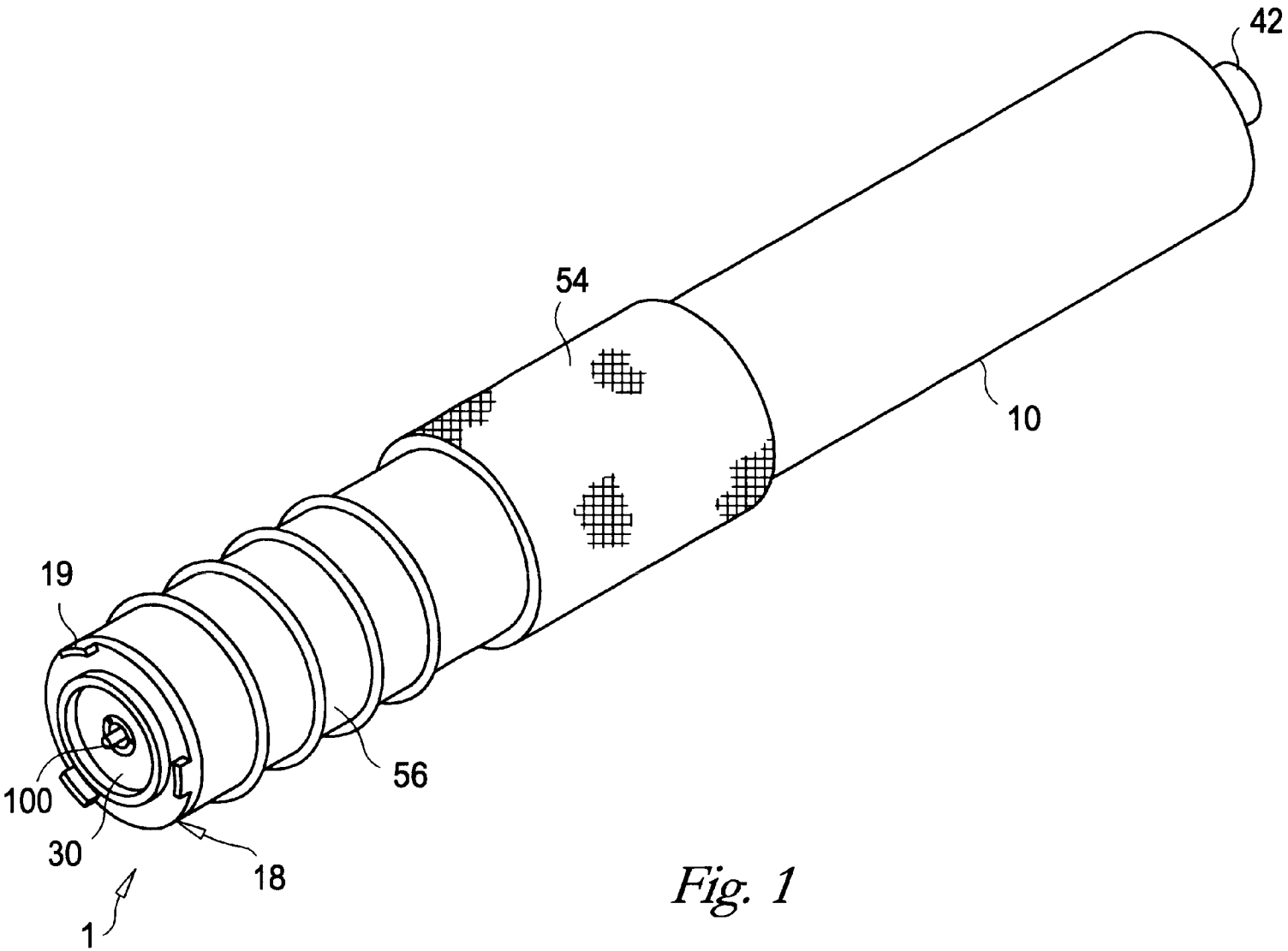
FIG. 1 is a front perspective view of an orbital marking pencil in accordance with the present invention.
Figure 2:
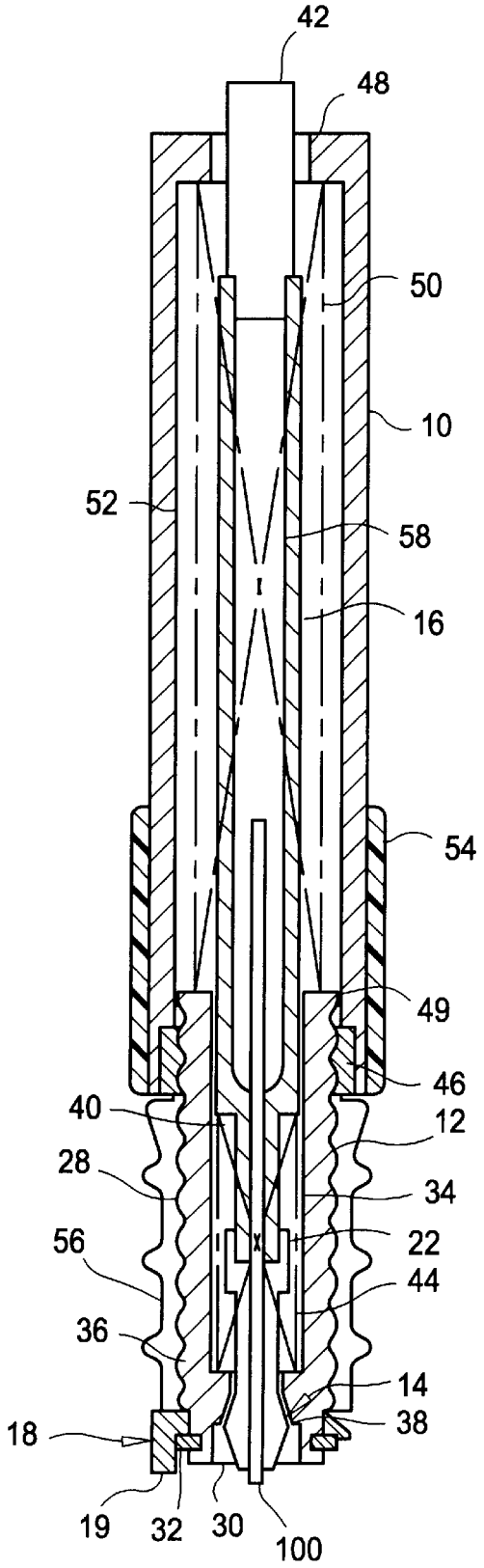
FIG. 2 is a cross sectional view of an orbital marking pencil in accordance with the present invention.
Figure 3:
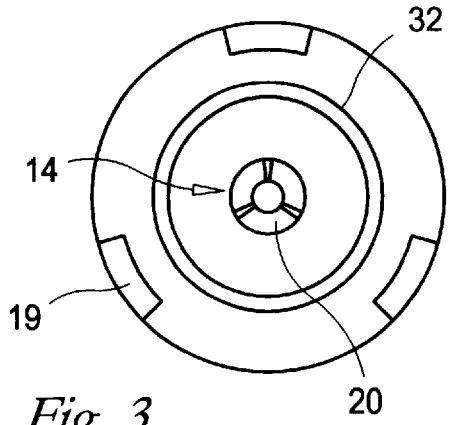
FIG. 3 is an enlarged bottom end view of an orbital marking pencil in accordance with the present invention.
Figure 4:
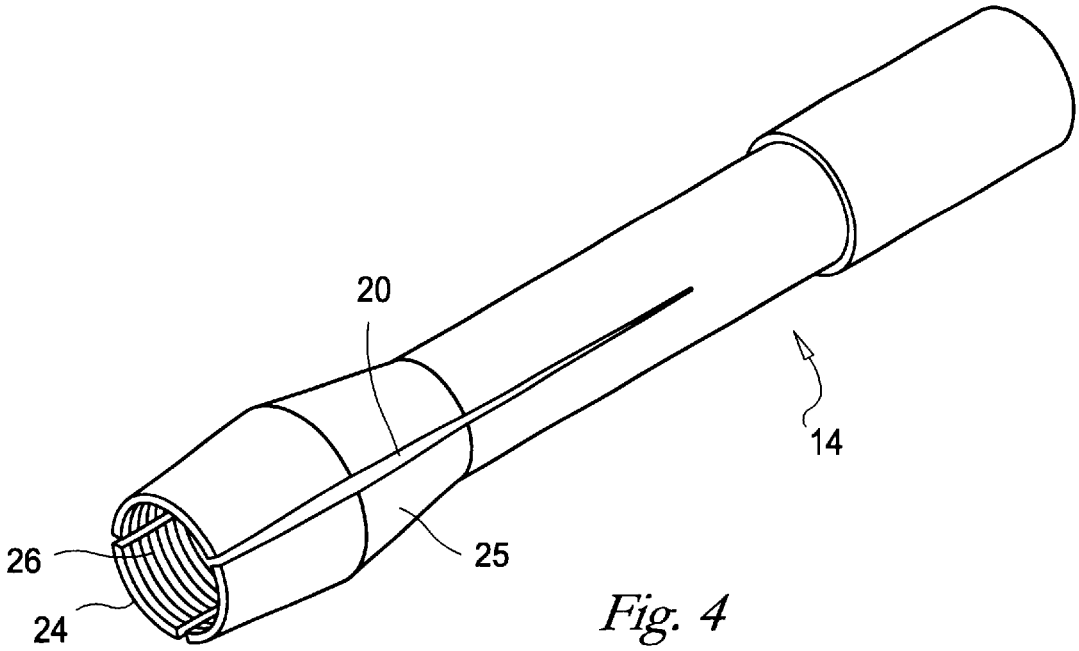
FIG. 4 is an enlarged perspective view of a marking collet of an orbital marking pencil in accordance with the present invention.

With reference now to the drawings, and particularly to FIG. 1, there is shown a front perspective view of an orbital marking pencil 1. With reference to FIGS. 2–4, the marking retention body 10, marking convoluted body 12, a marking collet 14, actuation tube 16 and rotational support 18 are shown. At least two lead griping fingers 20 are formed on one end of the marking collet 14 and a tube bore 22 is formed on the other end thereof. A tapered portion 25 is formed on substantially the one end of the marking collet 14. The tube bore 22 is sized to receive the actuation tube 16. The actuation tube 16 must not pull out of the tube bore 22 during use. The inside diameter 24 of the at least two lead gripping fingers 20 are sized to firmly retain a piece of lead. Serrations 26 may be formed on the inside diameter 24 to aid in the retention of a piece of lead 100.

A convoluted thread 28 is formed on an outside diameter of the marking convoluted body 12. A projection 30 is formed on one end of the marking convoluted body 12. The outer diameter of the projection 30 is sized to rotably receive an inner diameter of the rotational support 18. Preferably, the rotational support 18 is rotably retained on the marking convoluted body with a snap ring 32. The rotational support 18 preferably has at least three projection feet 19. The rotational support 18 is preferably fabricated from a see-through or clear material to facilitate locating the orbital marking pencil 1 directly over a score space. A first bore 34 is formed through substantially the length of the marking convoluted body 12. A second bore 36 is formed from a bottom of the first bore 34 through the one end of the marking convoluted body 12. The second bore 36 is terminated with a tapered exit 38. The tapered exit 38 is sized to receive the tapered portion 25 of the marking collet 14 for gripping a piece of lead 100.

One end of the actuation tube 16 has a reduced diameter 40 which is sized to be received by the tube bore 22. A push plug 42 is inserted into the other end of the actuation tube 16. A first compression spring 44 is inserted into the first bore 34 before insertion of the actuation tube 16 into the marking collet 14 for retaining the collet within the convoluted body. A convoluted nut 46 is formed on one end of the retention body 10 and a tube opening 48 is formed through the other end thereof. The convoluted nut 46 threadably receives the marking convoluted body 12 and the tube opening 48 provides clearance for the push plug 42. The pitch of the convoluted thread 28 is such that pushing down on the marking convoluted body 12 will cause thereof to thread into the convoluted nut 46. At least one retention dimple 49 is formed on the other end of the marking convoluted body 12 to prevent thereof from falling out of the convoluted nut 46.

A second compression spring 50 is inserted into a spring bore 52 formed through substantially the length of the marking retention body 10 before the convoluted nut 46 is formed on the marking retention body 10. The second spring 50 forces the convoluted body into an extended position. A rubber finger grip 54 is preferably formed on substantially the one end of the marking retention body 10. A rubber boot 56 preferably covers the marking convoluted body 12. The rubber boot 56 is slipped over the marking convoluted body 12 before threading thereof into the convoluted nut 46.

A piece of lead 100 is inserted into the marking collet 14 by depressing the push plug 42 and inserting the piece of lead 100 directly into the marking collet 14 into a tube bore of the actuation tube 16. More than one piece of lead may be inserted into a tube bore 58 of the actuation tube 16. To mark a score space, the lead is preferably placed directly over a score space using the rotational support 18 as a guide for sliding the orbital marking pencil 1 over a score sheet. The rotational support 18 also keeps the orbital marking pencil 1 vertical. The orbital marking pencil may be used without the rotational support 18. The marking retention body 10 is pushed downward until the marking convoluted body 12 fully threads into the convoluted nut 46 which enables the collet to rotate relative to a writing surface as the retention body is pushed toward the writing surface. The marking retention body 10 is pushed down as many times as required to darken the score space.

Figure 6:
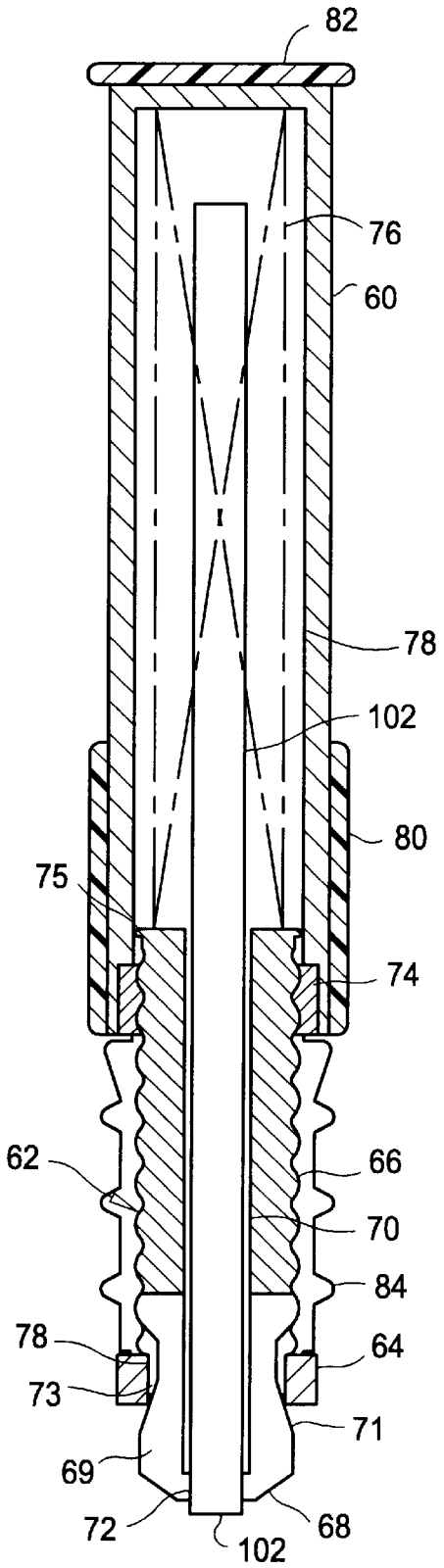
FIG. 6 is a cross sectional view of an orbital scratch-off card remover in accordance with the present invention.
Figure 5:
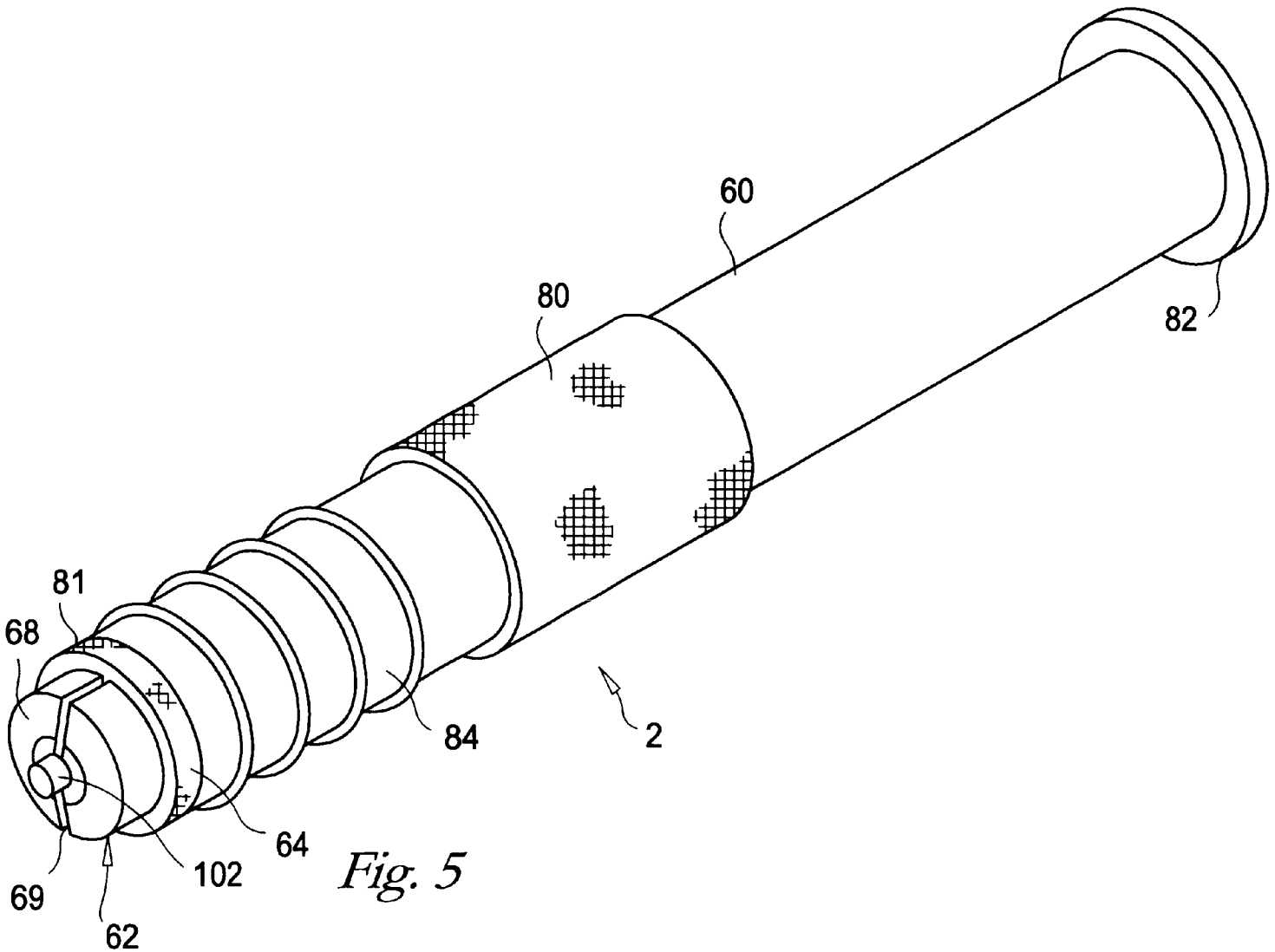
FIG. 5 is a front perspective view of an orbital scratch-off card remover in accordance with the present invention.
Figure 7:
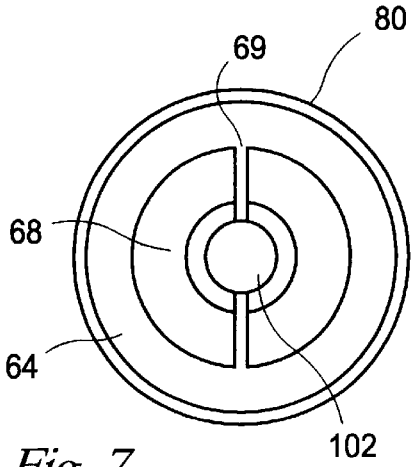
FIG. 7 is a bottom end view of an orbital scratch-off card remover in accordance with the present invention.

With reference to FIGS. 5–7, the orbital scratch-off card remover 2 includes a remover retention body 60, remover convoluted body 62, and a lock ring 64. A convoluted thread 66 is formed on an outside diameter of the remover convoluted body 62. At least two griping fingers 68 are formed on one end of the remover convoluted body 62 by creating a slit 69. A single additional slit produces an additional gripping finger. A sloping area 71 is formed behind the one end of the remover convoluted body 62. A tapered entrance 73 is formed on an inside bore 78 of the lock ring 64. The sloping area 71 mates with the tapered entrance 73 such that forcing the lock ring 64 toward the one end of the remover convoluted body 62 forces the gripping fingers 68 together on a remover rod 102; the lock ring 64 also becomes locked on the at least two griping fingers 68. A roughened surface 81 is preferably formed on an outer diameter of the lock ring 64. The remover rod may be an eraser for removing pencil or ink. The remover rod 102 may also be a hard felt tip for removing the cover layer of a scratch-off card. Other materials or items may also be used as remover rods.

A first bore 70 is formed through substantially the length of the remover convoluted body 62. A second bore 72 is formed from a bottom of the first bore 70 through the one end of the remover convoluted body 62. A convoluted nut 74 is formed on one end of the remover retention body 60. The convoluted nut 74 threadably receives the convoluted thread 66. The pitch of the convoluted thread 66 is such that pushing down on the remover convoluted body 62 will cause thereof to thread into the convoluted nut 74. At least one retention dimple 75 is formed on the other end of the remover convoluted body 62 to prevent thereof from falling out of the convoluted nut 74. A compression spring 76 is inserted into a spring bore 78 formed through substantially the length of the remover retention body 60 before the convoluted nut 74 is formed on the remover retention body 60. A rubber finger grip 80 is preferably formed on substantially the one end of the remover retention body 60. A hand stop 82 is preferably formed on the other end of the remover retention body 60.

A rubber boot 84 preferably covers the remover convoluted body 62. The rubber boot 84 is slipped over the remover convoluted body 62 before threading thereof into the convoluted nut 74. A remover rod 102 is inserted into the at least two gripper fingers 68 of the remover convoluted body 62. The remover rod 102 is positioned to remove a portion of a cover layer from a scratch-off card and the lock ring is pushed on to the sloping area 71 of the at least two gripper fingers 68. To remove the cover layer of a scratch-off card, the remover rod 102 is placed directly over the area to be removed and the remover retention body 60 is griped on the finger grip 80 or palmed on the hand stop 82 and pushed downward until the remover convoluted body 62 fully threads into the convoluted nut. The remover retention body 60 is pushed down as many times as required to remove a portion of the cover layer.

Figure 8:
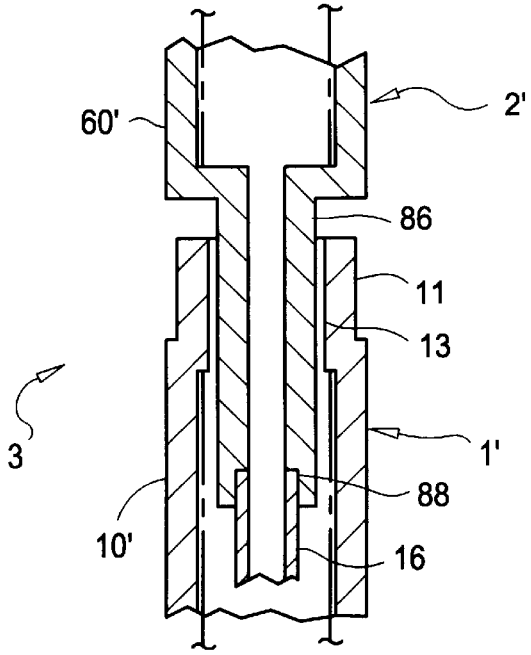
FIG. 8 is a partial cross-sectional view of a combination orbital marking pencil and scratch-off card remover in accordance with the present invention.
Figure 9:
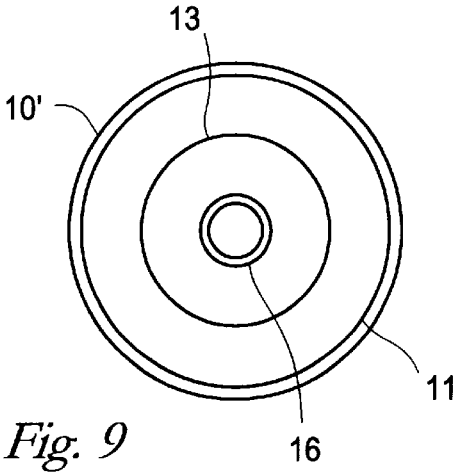
FIG. 9 is a top view of a marking pencil of a combination orbital marking pencil and scratch-off card remover in accordance with the present invention.
Figure 10:
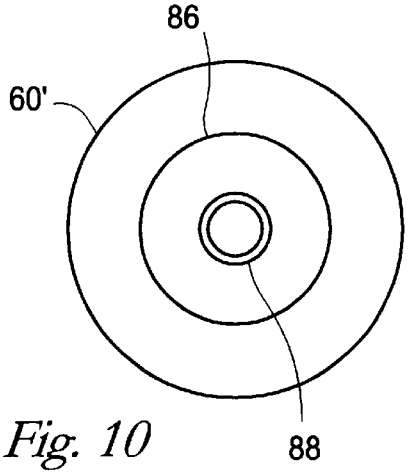
FIG. 10 is a top view of a scratch-off card remover of a combination orbital marking pencil and scratch-off card remover in accordance with the present invention.

With reference to FIGS. 8–10, a combination orbital marking pencil and scratch-off card remover 3 may be fabricated by modifying the other ends of the marking and remover retention bodies. A guide extension 11 extends from the other end of the marking retention body 10'. A guide bore 13 is formed in the guide extension 11 to slidably receive an actuation projection 86. The actuation projection 86 extends from the other end of the remover retention body 60'. A tube bore 88 is formed on an end of the actuation projection 86 to receive the actuation tube 16. A piece of lead from the orbital marking pencil 1' is dispensed by pushing the remover retention body 60 toward the marking retention body 10'.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An orbital marking pencil comprising:

a retention body having a spring bore formed through substantially the length thereof;

an actuation tube having a reduced diameter;

a collet having at least two gripping fingers on one end and a bore sized to receive said reduced diameter on the other end thereof;

a convoluted body having a convoluted thread formed on an outside diameter thereof, said convoluted body having a bore formed therein which is sized to receive said collet, said collet being retained in said convoluted body with a first spring;

a convoluted nut being attached to one end of said retention body, said convoluted nut threadably receiving said convoluted thread, said convoluted body being forced to an extended position with a second spring, wherein writing lead is adapted to be inserted into said collet and said collet rotates relative to a writing surface as said retention body is pushed toward the writing surface.

2. The orbital marking pencil of claim 1, further comprising:

a rotational support being pivotally attached to said convoluted body adjacent said at least two gripping fingers.

3. The orbital marking pencil of claim 1, further comprising:

a boot being placed over said convoluted body.

4. The orbital marking pencil of claim 1, further comprising:

a finger grip being formed on said retention body.

5. An orbital marking pencil comprising:

a retention body;

an actuation tube having a reduced diameter on one end thereof;

a collet having at least two gripping fingers on one end and a bore sized to receive said reduced diameter on the other end thereof;

a convoluted body having a convoluted thread formed on an outside diameter thereof, said convoluted body having a bore formed therein which is sized to receive said collet; and a convoluted nut being attached to one end of said retention body, said convoluted nut threadably receiving said convoluted thread, wherein writing lead is adapted to be inserted into said collet and said collet rotates relative to a writing surface as said retention body is pushed toward the writing surface.

6. The orbital marking pencil of claim 5, further comprising:

said collet being retained in said convoluted body with a first spring.

7. The orbital marking pencil of claim 6, further comprising:

said convoluted body being forced to an extended position with a second spring.

8. The orbital marking pencil of claim 5, further comprising:

a rotational support being pivotally attached to said convoluted body adjacent said at least two gripping fingers.

9. The orbital marking pencil of claim 5, further comprising:

a boot being placed over said convoluted body.

10. The orbital marking pencil of claim 5, further comprising:

a finger grip being formed on said retention body.

* * * * *